US007938759B1

(12) United States Patent
Gaynor

(10) Patent No.: US 7,938,759 B1
(45) Date of Patent: May 10, 2011

(54) FREESTANDING ATHLETIC TRAINING APPARATUS AND ASSOCIATED METHOD

(76) Inventor: Tyrone Gaynor, Orange, NJ (US)

( * ) Notice: Subject to any disclaimer, the term of this patent is extended or adjusted under 35 U.S.C. 154(b) by 0 days.

(21) Appl. No.: 12/635,650

(22) Filed: Dec. 10, 2009

Related U.S. Application Data

(60) Provisional application No. 61/203,289, filed on Dec. 22, 2008.

(51) Int. Cl.
*A63B 69/34* (2006.01)

(52) U.S. Cl. ..... 482/83; 482/86

(58) Field of Classification Search ..... 482/83–90; 273/317.8, 440.1; 40/607.01; 473/429
See application file for complete search history.

(56) References Cited

U.S. PATENT DOCUMENTS

| | | | | | |
|---|---|---|---|---|---|
| 1,708,638 | A * | 4/1929 | Smith | 473/442 |
| 3,304,089 | A * | 2/1967 | Smith | 473/440 |
| 3,390,880 | A * | 7/1968 | Forrest | 473/441 |
| 3,813,095 | A * | 5/1974 | Long | 482/87 |
| 4,508,339 | A * | 4/1985 | Llewellyn | 473/429 |
| 4,749,184 | A * | 6/1988 | Tobin | 482/87 |
| 5,437,590 | A * | 8/1995 | D'Alto | 482/90 |
| 5,472,186 | A * | 12/1995 | Paulsen | 473/429 |
| 5,674,157 | A * | 10/1997 | Wilkinson | 482/83 |
| 5,899,835 | A * | 5/1999 | Puranda | 482/90 |
| 5,941,801 | A * | 8/1999 | D'Alto | 482/90 |
| 6,398,697 | B1 * | 6/2002 | Nichols, Jr. | 482/87 |
| 6,786,854 | B1 * | 9/2004 | Hsu | 482/83 |
| 6,994,658 | B2 * | 2/2006 | Laudenslager et al. | 482/83 |
| 7,008,353 | B2 * | 3/2006 | Haeffer | 482/83 |
| 7,297,092 | B1 * | 11/2007 | Gaynor | 482/86 |
| 2005/0124469 | A1 * | 6/2005 | Melvin | 482/83 |

* cited by examiner

*Primary Examiner* — Rinaldi I Rada
*Assistant Examiner* — Andrew M Tecco

(57) ABSTRACT

A free standing athletic training apparatus includes a base section, a central post section, a swiveling arm section and a multi-section body. The central post section may be statically mated to the base section. The swiveling arm section may be rotatably attached to the central post section. The multi-section body may be positioned about the central post section and may be located beneath the swiveling arm section. The multi-section body may be formed from foam and may include a vertically stacked bottom, middle, and top sections. The swiveling arm section may maintain an adjustable rotational engagement with the upper most tip of the central post section such that it may maintain a high and low frictional contact with the upper most tip when the swiveling arm is linearly lowered and raised along the central longitudinal axis of the central post section.

6 Claims, 9 Drawing Sheets

*Fig. 19a*
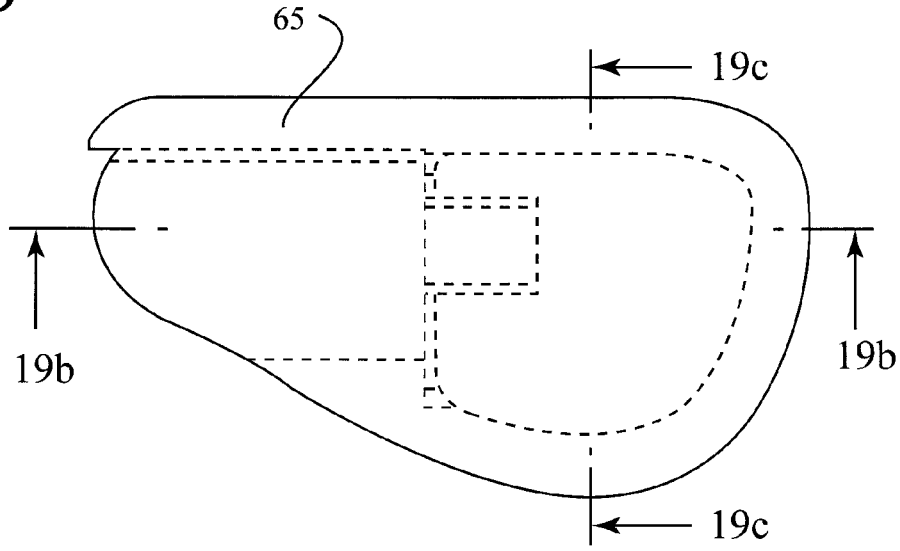
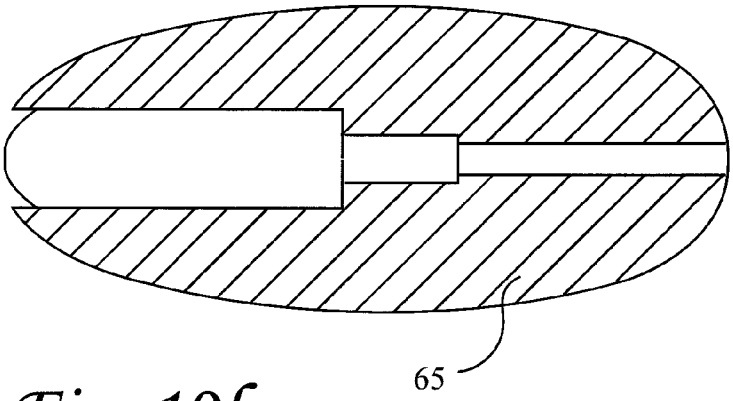
*Fig. 19b*
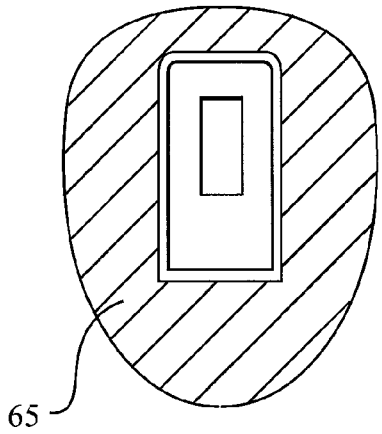
*Fig. 19c*

FREESTANDING ATHLETIC TRAINING APPARATUS AND ASSOCIATED METHOD

CROSS REFERENCE TO RELATED APPLICATIONS

This application claims the benefit of U.S. Provisional Application No. 61/203,289, filed Dec. 22, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to sports training equipment and, more particularly, to a freestanding athletic training apparatus for providing users with an easy and convenient means of improving aerobic endurance and stamina.

PRIOR ART

Today there is a great emphasis on physical fitness. Popular with many people are boxing, kick boxing, karate and other martial arts which offer the practitioners both physical fitness and self protection. Students of such self defense arts often use pads that are struck with their hands and/or feet to improve hand-eye coordination and to improve their strength. These pads are usually held by the instructor or another student in the class.

There are a number of drawbacks to this practice of having a second party hold the strike bag for another person. First and foremost, there is a possibility that the person striking the bag may do so with such a force that they actually injure the person holding the bag, or they can accidentally misjudge the location of the bag and strike the bag holder. Another disadvantage, especially when the instructor is holding the bag, is that it is hard for the instructor to evaluate the striker's performance and form from behind the strike bag.

U.S. Pat. No. 7,297,092 discloses an exercise training device that is commonly owned by the inventor of the present invention. The entire contents of such a patent are incorporated herein by reference.

Accordingly, a need remains for an apparatus in order to overcome the above-noted shortcomings. The present invention satisfies such a need by providing a freestanding athletic training apparatus that is convenient and easy to use, lightweight yet durable in design, versatile in its applications, and designed for providing a user with an effective means of improving aerobic endurance and stamina.

BRIEF SUMMARY OF THE INVENTION

In view of the foregoing background, it is therefore an object of the present invention to provide a freestanding athletic training apparatus for improving aerobic endurance and stamina. These and other objects, features, and advantages of the invention are provided by a freestanding athletic training apparatus that may include a base section, a central post section, a swiveling arm section and a multi-section body.

The central post section may be statically mated to the base section and may extend upwardly therefrom. Such a central post section may further include an upper most tip axially aligned with a central longitudinal axis of the base section. The swiveling arm section may be rotatably attached to the central post section. The multi-section body may be positioned about the central post section and may be located beneath the swiveling arm section. Such a multi-section body may be formed from foam and may include vertically stacked bottom, middle, and top sections, respectively.

Advantageously, the swiveling arm section may maintain an adjustable rotational engagement with the upper most tip of the central post section such that it maintains high and low frictional contact with the upper most tip when the swiveling arm is linearly lowered and raised along the central longitudinal axis of the central post section, respectively. Such an arrangement provides the unexpected and unpredictable advantage of allowing the swiveling arm to be adjustably abutted around the central post section when as the frictional contact is biased between high and low positions.

In one embodiment, the swiveling arm section may include a bore extending downwardly from a top surface of the rotating arm. An insert may be inserted into the bore and a helical spring member may be seated external of the bore. A first spring retainer and a second spring retainer may further be positioned external of the rotating arm above the bore, respectively. In addition, a retaining cap may be adjustably positioned external of the bore and may include a threadable member such that the retaining cap may be adjustably mated with the upper most tip of the central post section. In this way, the helical spring member may be biased between compressed and equilibrium positions respectively when the retaining cap is threadably adjusted along an axially oriented linear path defined along the central longitudinal axis.

The first spring retainer and the second spring retainer may be positioned below the retaining cap and above the bore respectively, to thereby retain the spring member vertically aligned with the central longitudinal axis as the spring member is biased between compressed and equilibrium positions, respectively. In this way, the frictional contact increases and decreases as the first and second spring retainers move towards and away from each other. Such an arrangement provides the unexpected and unpredictable benefit of reducing vibration and sporadic movement of the rotating arms as the rotating arm is punched and kicked. In this manner, the rotating arm is adjustably held with varying frictional forces created by the spring mechanism as the rotating arm is rotated around the central post section.

In one embodiment, the swiveling arm section may further include a channel groove formed on its bottom face, such that a hollow punch support may be linearly positioned into the channel groove of the rotating arm. The swiveling arm section may further include a planar punch plate preferably having a plurality of notches formed along a leading end, such that the notches may receive a plurality of outer edges located at a trailing end of the punch support. The swiveling arm may further include a foam pad covering the punch plate.

Further, a rotating arm cover may be fitted into the channel groove of the rotating arm and thereby holds the punch support at a fixed position. Such an arrangement provides the unexpected and unpredictable benefit of enabling the swiveling arm to be removably fitted with different sized punch plates according to different users' needs. The foam pad may further protect a user's hands and feet from injury.

In one embodiment, the base section may include a centrally oriented axial bore and a base plate fitted over a bottom end of the axial bore. A locking bolt preferably penetrates through the base plate and is connected to the central post section to maintain the central post section at a fixed and static position when the swivel arm section rotates against the upper most tip of the central post section. Such an arrangement provides the unexpected and unpredictable benefit of enabling the apparatus to be maintained at a stable and upright position when a rotational force is applied to the swiveling arm section.

In one embodiment, the central post section may include a plurality of linearly oriented posts and a support plate concentrically mounted about a first one of the rectilinear posts such that the support plate receives and supports the multi-section body. A tightening sleeve may be mounted about a second one of the posts and is thereby seated directly on the base section such that the base section is prohibited from being linearly displaced along the second post. Such an arrangement provides the unexpected and unpredictable benefit allowing the apparatus to be adjustable in height according to the needs of users without compromising the rigidity and durability of the central post section.

The invention may include a method of utilizing a freestanding athletic training apparatus for improving aerobic endurance and stamina. Such a method preferably includes the chronological steps of: providing a base section; and providing and statically mating a central post section to the base section such that the central post section extends upwardly from the base section. Such a central post section preferably has an upper most tip axially aligned with a central longitudinal axis of the base section.

The method may additionally include the chronological steps of: providing and rotatably attaching a swiveling arm section to the central post section; and providing and positioning a multi-section body beneath the swiveling arm section by locating the multi-section body about the central post section The method may further include the step of: maintaining an adjustable rotational engagement between the swiveling arm section and the upper most tip of the central post section in such a manner that the adjustable rotational engagement maintains high and low frictional contact with the upper most tip when the swiveling arm is linearly lowered and raised along the central longitudinal axis respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 19*a* is a front elevational view of the foam pad shown in shown in FIG. 1;

FIG. 19*b* is a cross-sectional view of the foam pad along 19*b*-19*b* shown in FIG. 19*a;*

FIG. 19*c* is a cross-sectional view of the foam pad along 19*c*-19*c* shown in FIG. 19.

Figure 1:
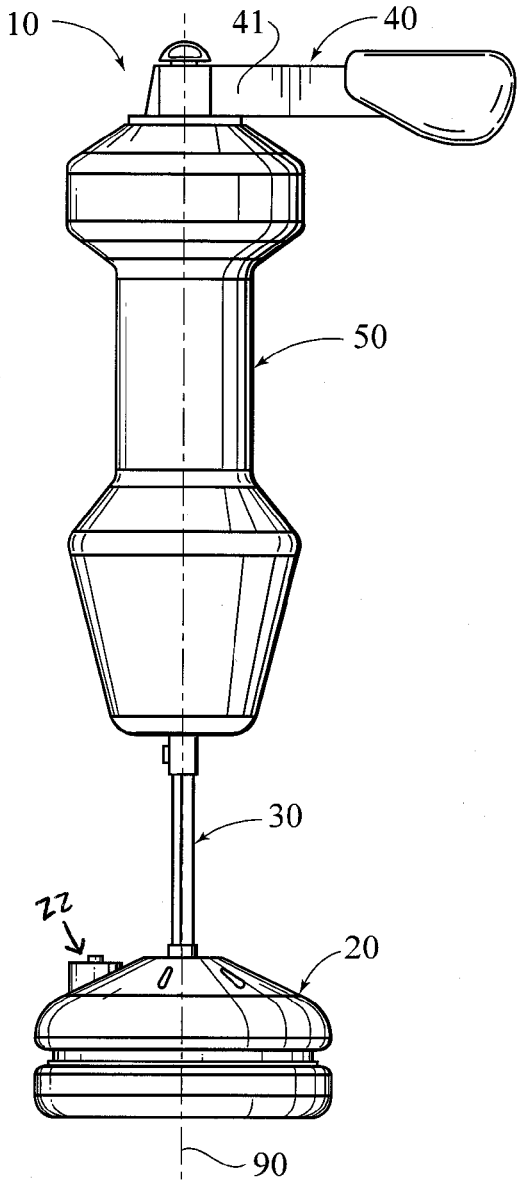
FIG. 1 is a front elevational view showing a freestanding athletic training apparatus, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in figures by the reference numeral 10 and is intended to provide a freestanding athletic training apparatus. It should be understood that the freestanding athletic training apparatus 10 may be used to provide users with a means of improving aerobic endurance and stamina and many other different types of combat strikes.

Referring generally to FIGS. 1-20, a freestanding athletic training apparatus 10 may include a base section 20, a central post section 30, a swiveling arm section 40 and a multi-section body 50.

Figure 2:
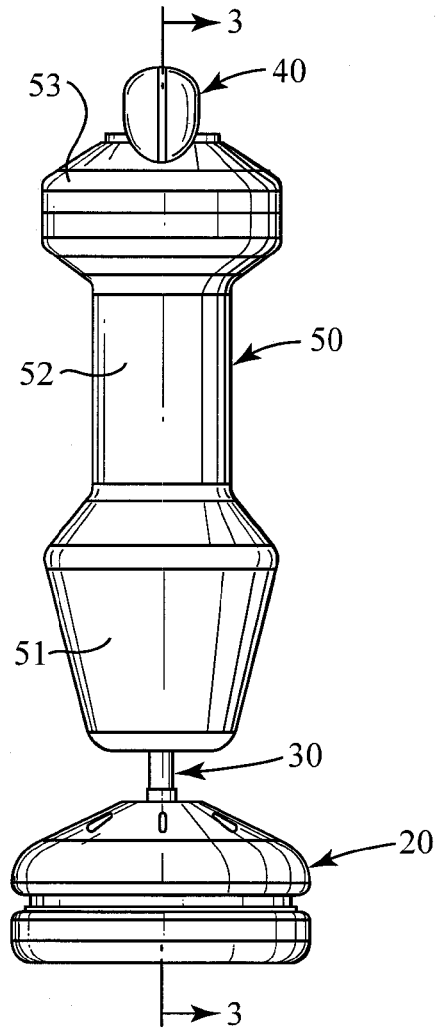
FIG. 2 is a side elevational view of the apparatus shown in FIG. 1.
Figure 3:
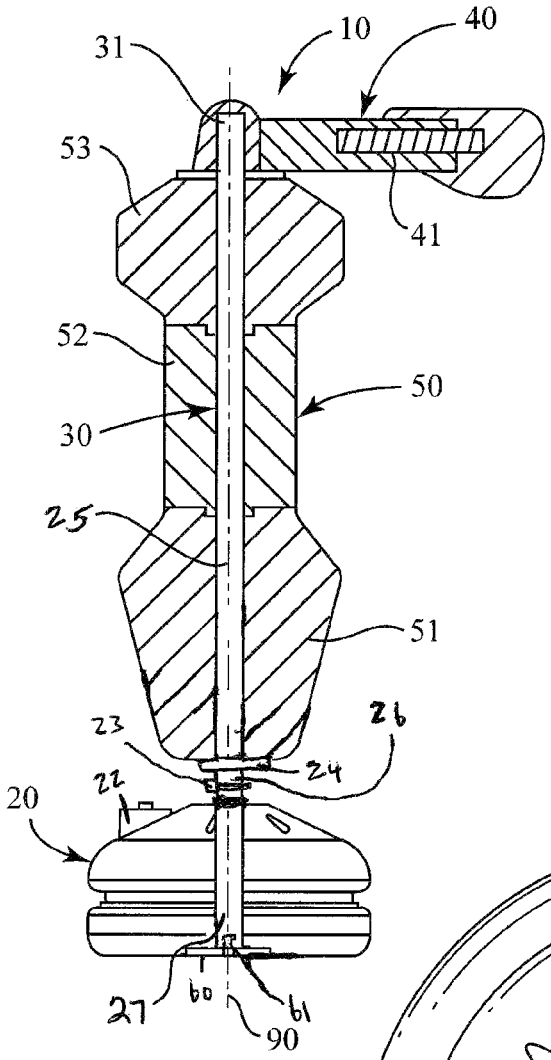
FIG. 3 is a cross-sectional view of the apparatus along line 3-3 as shown in FIG. 2.
Figure 4:
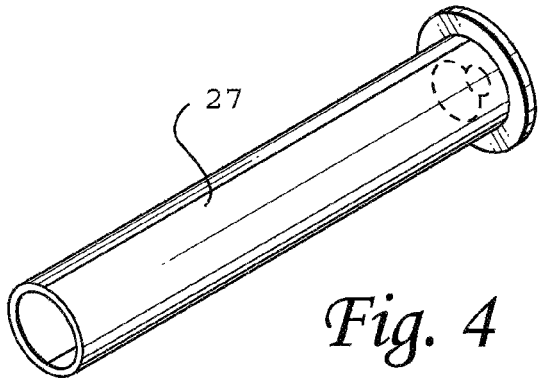
FIG. 4 is a perspective view of the locking bolt shown in FIG. 3.
Figure 5:
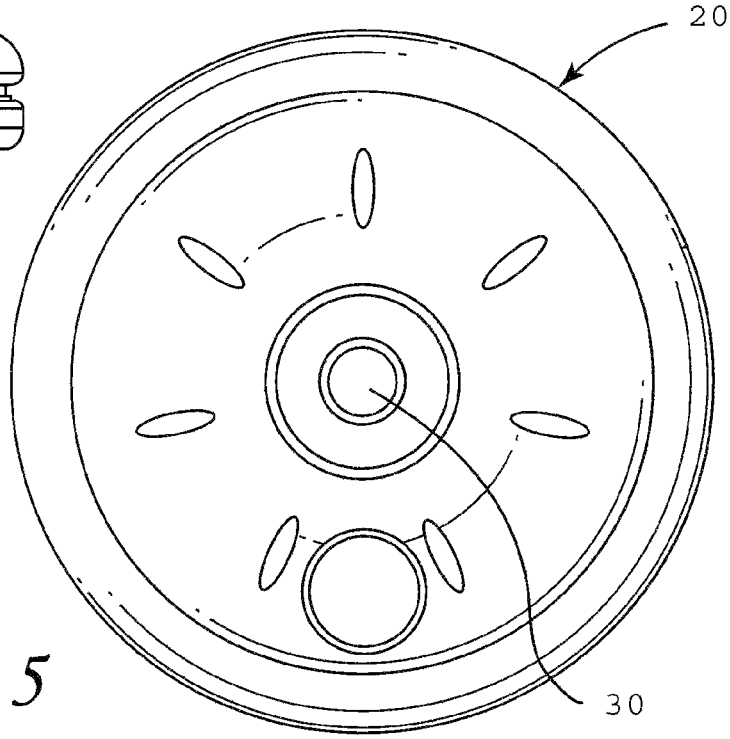
FIG. 5 is a top plan view of the base section showing its axial bore.
Figure 6:
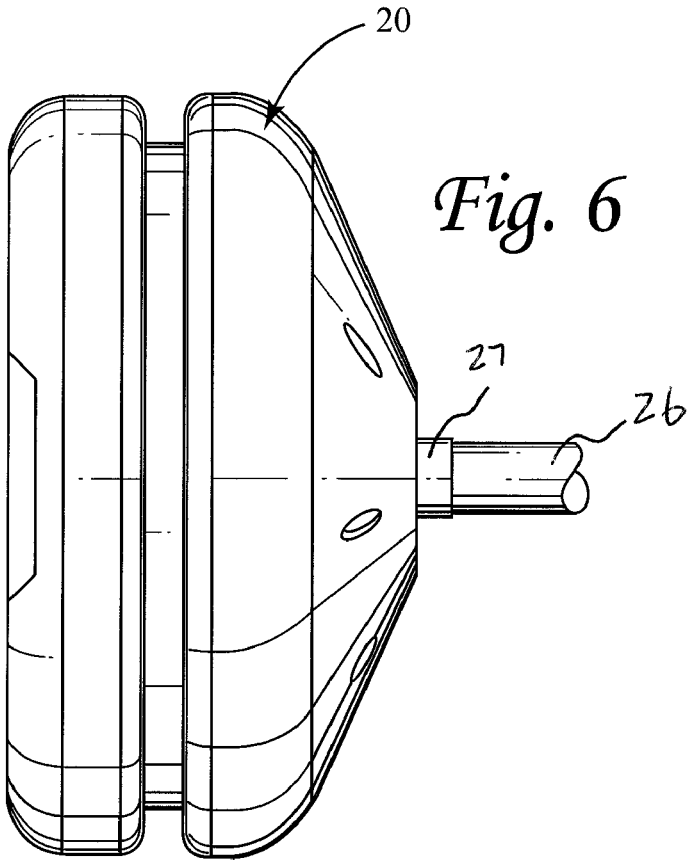
FIG. 6 is a side elevational view of the base section.
Figure 7:
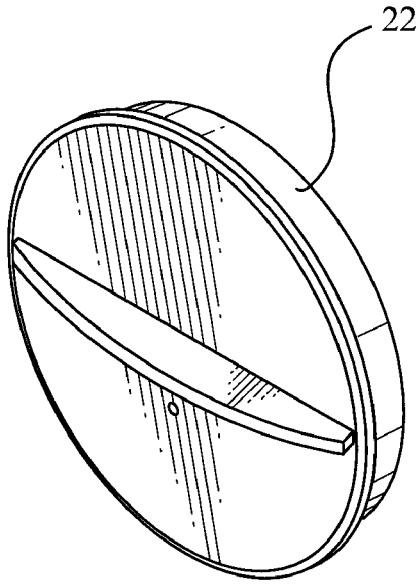
FIG. 7 is a perspective view of the base plate shown in FIG. 1.
Figure 8:
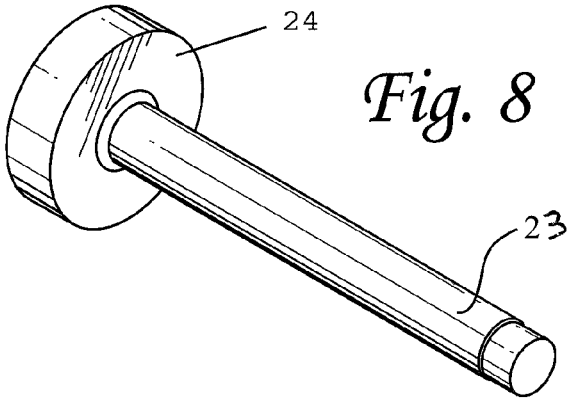
FIG. 8 is a perspective view of the first rectilinear post shown in FIG. 1.
Figure 9:
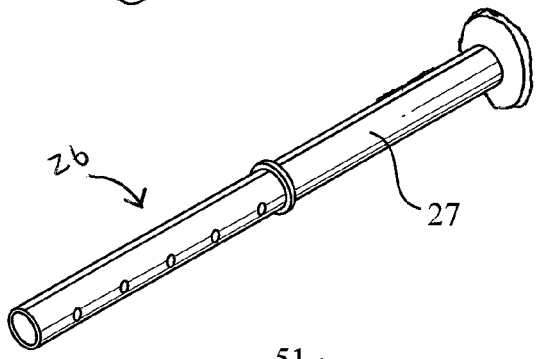
FIG. 9 is a perspective view of the second rectilinear post shown in FIG. 1.
Figure 10:
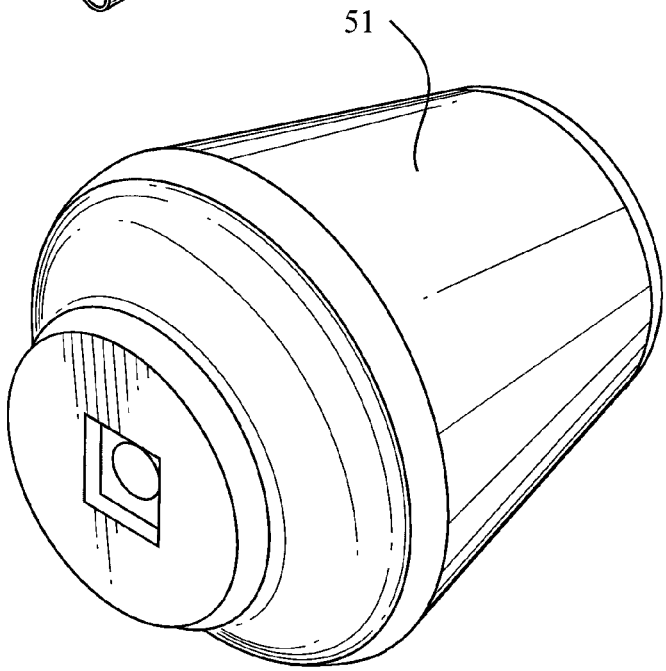
FIG. 10 is a perspective view of the bottom section of the multi-section body shown in FIG. 1.
Figure 11:
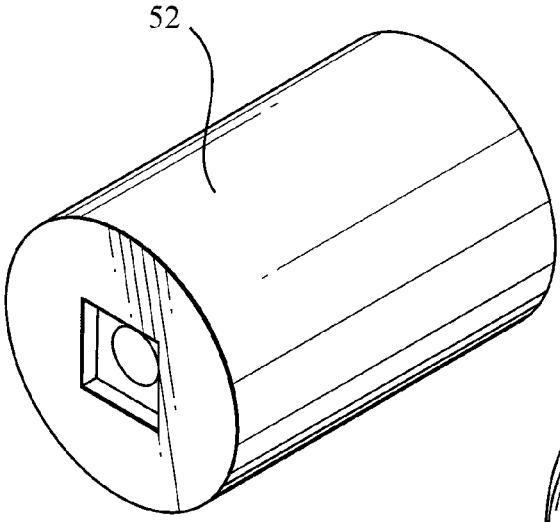
FIG. 11 is a perspective view of the middle section of the multi-section body shown in FIG. 1.
Figure 12:
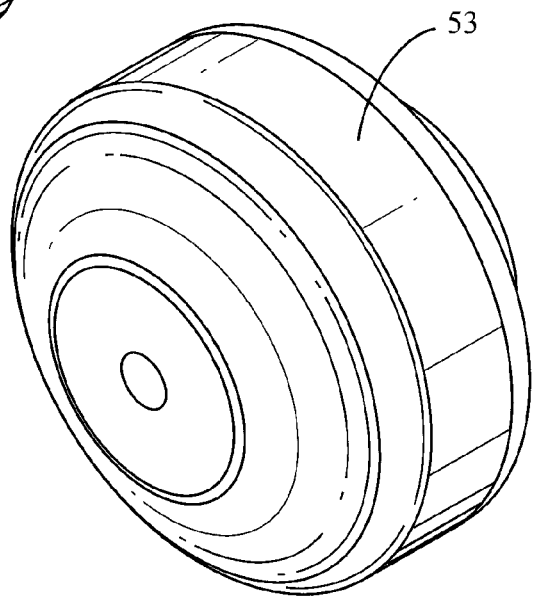
FIG. 12 is a perspective view of the top section of the multi-section body shown in FIG. 1.
Figure 13:
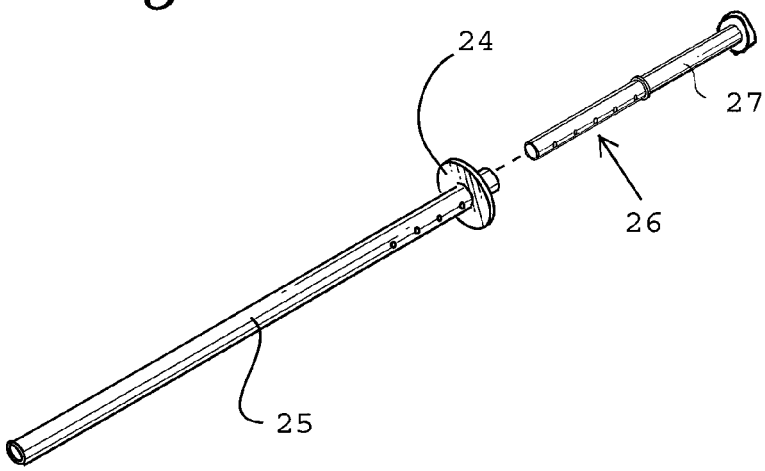
FIG. 13 is a perspective view of the first rectilinear post and support plate of the central post section shown in FIG. 1.

Referring initially to FIGS. 1-3, the central post section 30 may be statically mated to the base section 20 and may extend upwardly from the base section 20. Such a central post section may further include an upper most tip 31 axially aligned with a central longitudinal axis 90 of the base section 20. The swiveling arm section 40 may further be rotatably attached to the central post section 30. The multi-section body 50 may further be positioned about the central post section 30 and may be located beneath the swiveling arm section 40. Such a multi-section body 50 may be formed from foam and may include vertically stacked bottom section 51, a middle section 52, and a top section 53 respectively.

Advantageously, the swiveling arm section 40 may maintain an adjustable rotational engagement with the upper most tip 31 of the central post section 30 such that it maintains high and low frictional contact with the upper most tip 31 when the swiveling arm section 40 is linearly lowered and raised along the central longitudinal axis 90 of the central post section 30 respectively, as perhaps best shown in FIGS. 1-3. Such an arrangement provides the unexpected and unpredictable advantage of allowing the swiveling arm section 40 to be adjustably abutted around the central post section 30 when the frictional contact is biased between high and low positions.

Figure 14:
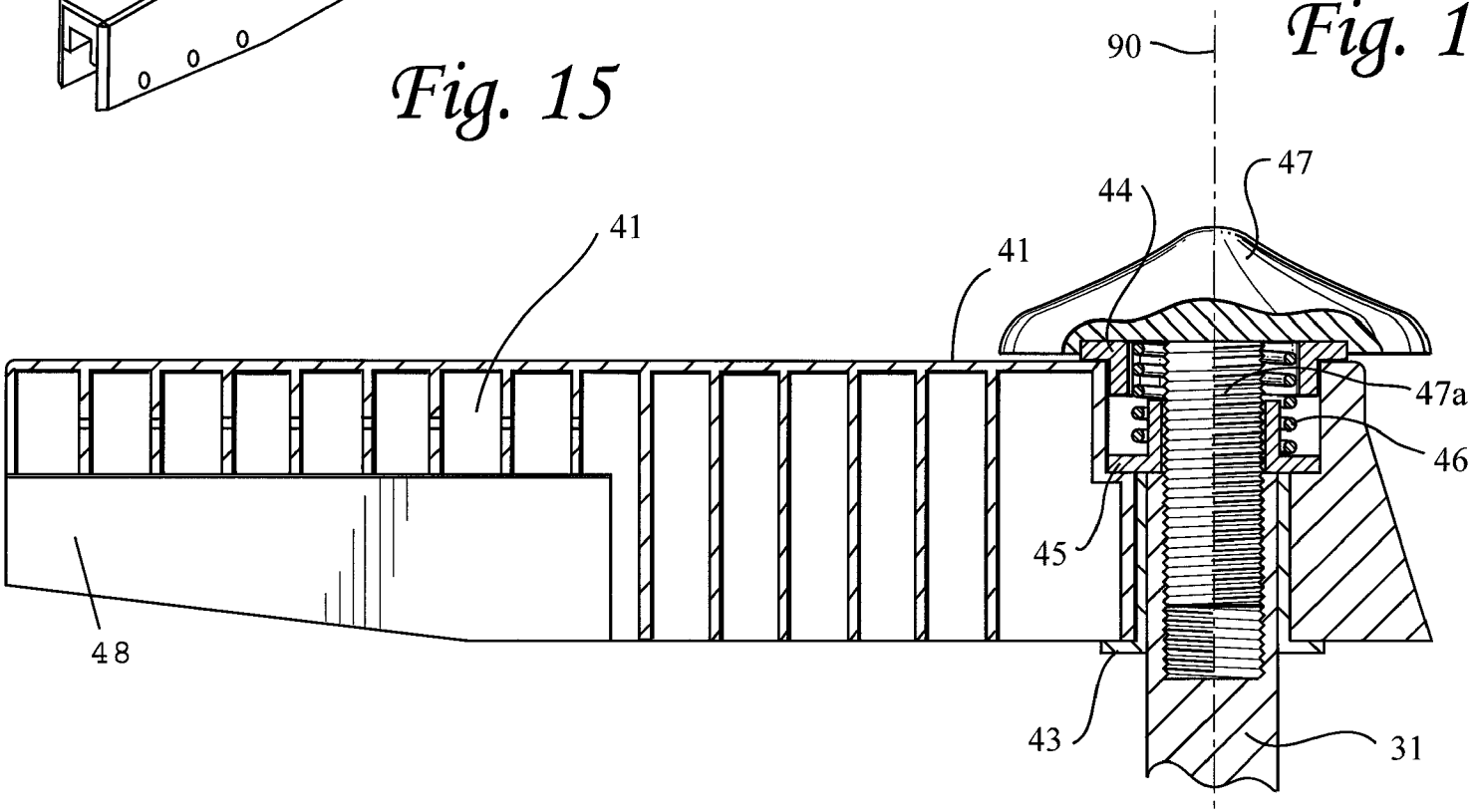
FIG. 14 is a cross-sectional view of the rotating arm shown in FIG. 1.
Figure 15:
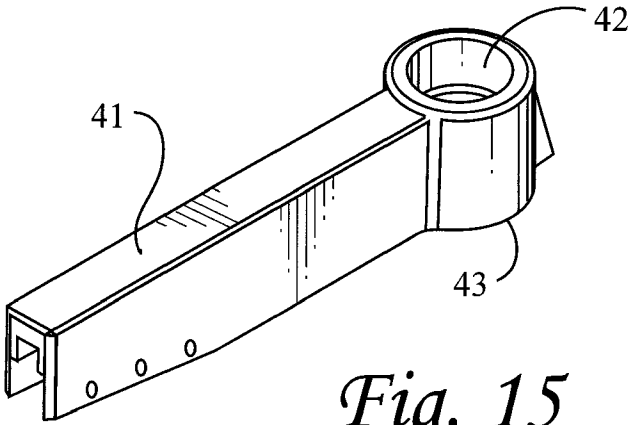
FIG. 15 is a perspective view of the rotation arm shown in FIG. 14.
Figure 17:
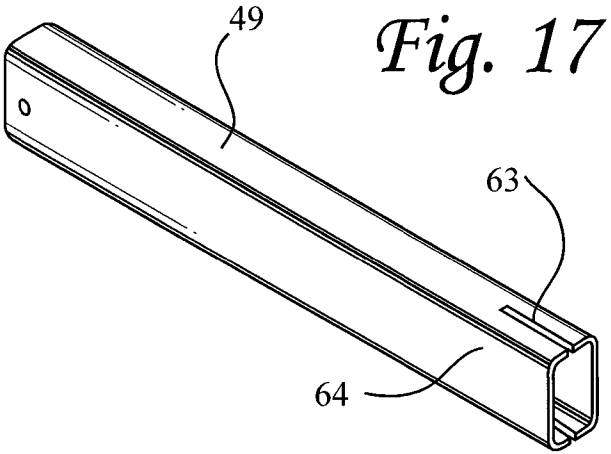
FIG. 17 is a perspective view of the punch support.
Figure 20:
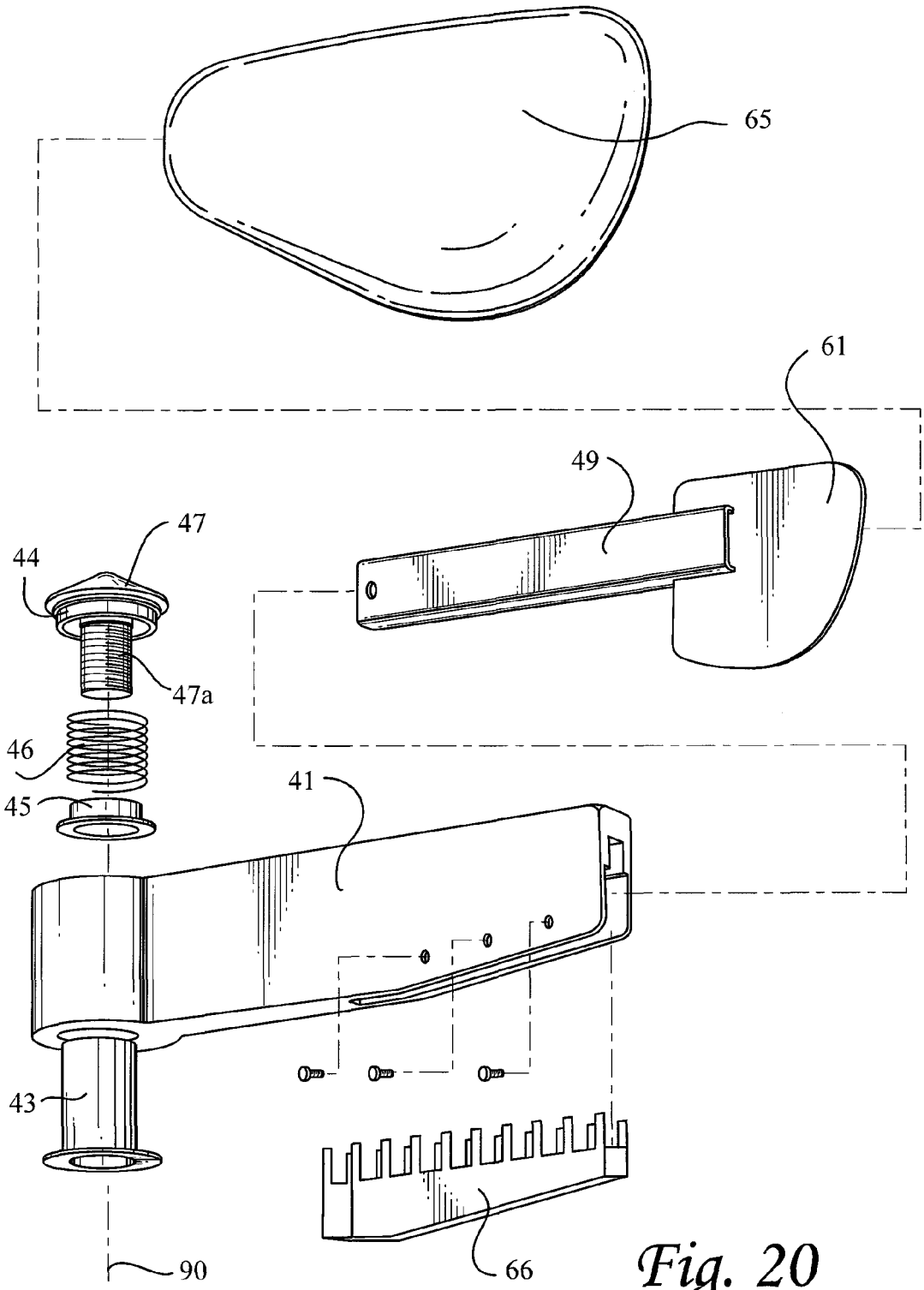
FIG. 20 is an expanded view of the swiveling arm section showing the relationship of its parts.

Referring to FIGS. 14, 15, and 20 the swiveling arm section 40 may include a bore 42 extending downwardly from a top surface of the rotating arm 41. An insert 43 may be inserted into the bore 42 and a helical spring member 46 may be seated external of the bore 42. A first spring retainer 44 and a second spring retainer 45 may further be positioned external of the rotating arm 41 above the bore 42 respectively. In addition, a retaining cap 47 may be adjustably positioned external of the bore 42 and may include a threadable member 47*a* such that the retaining cap 47 may be adjustably mated with the upper most tip 31 of the central post section 30. In this way, the helical spring member 46 may be biased between compressed and equilibrium positions respectively when the retaining cap 47 is threadably adjusted along an axially oriented linear path defined along the central longitudinal axis.

Referring to FIG. 20, the first spring retainer 44 and the second spring retainer 45 may be positioned below the retaining cap 47 and above the bore 42 respectively, to thereby retain the spring member 46 vertically aligned with the central longitudinal axis 90 as the spring member is biased between compressed and equilibrium positions respectively. In this way, the frictional contact increases and decreases as the first and second spring retainers 44, 45 move towards and away from each other. Such an arrangement provides the unexpected and unpredictable benefit of reducing vibration and sporadic movement of the rotating arms as the rotating arm 41 is punched and kicked. In this way, the rotating arm is adjustably held with varying frictional forces created by the spring mechanism as the rotating arm is rotated around the central post section 40.

Referring to FIGS. 15-20, the swiveling arm section 40 may further include a channel groove 48 formed on its bottom face, such that a hollow punch support 49 may be linearly positioned into the channel groove 48. The swiveling arm section 40 may further include a planar punch plate 61 preferably having a plurality of notches 62 formed along a leading end, such that the notches 62 may receive a plurality of outer edges 63 located at a trailing end 64 of the punch support 49. The swiveling arm section 40 may further include a foam pad 65 covering the punch plate 61.

Figure 16:
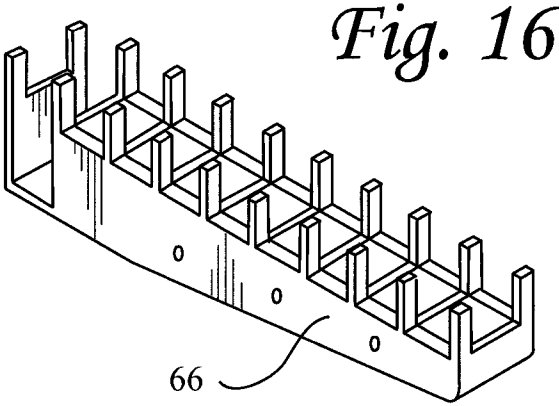
FIG. 16 is a perspective view of the rotating arm cover.
Figure 18:
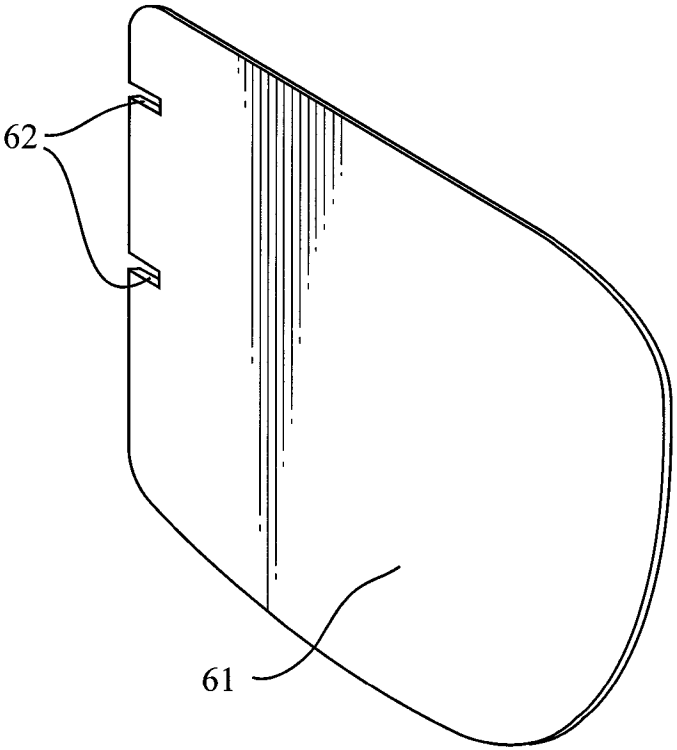
FIG. 18 is a perspective view of the punch plate.

Referring to FIG. 16 and FIG. 20, a rotating arm cover 66 may further be fitted into the channel groove 48 of the rotating arm 41 and thereby holds the punch support 49 at a fixed position. Such an arrangement provides the unexpected and unpredictable benefit of enabling the swiveling arm section 40 to be removably fitted with different sized punch plates 61 according to different users' needs. The foam pad may further protect a user's hands and feet from injury.

Referring to FIGS. 1-7, the base section 20 may include a centrally oriented axial bore 21 and a base plate 22 fitted over a bottom end of the axial bore 21. A locking bolt 23 penetrate through the base plate 22 and is connected to the central post section 30 to maintain the central post section 30 at a fixed and static position when the swivel arm section 40 rotates against the upper most tip 31 of the central post section 30. Such an arrangement provides the unexpected and unpredictable benefit of enabling the apparatus to be maintained at a stable position when a rotational force is applied to the swiveling arm section 40.

Referring to FIG. 3, 8, 9, 12-13, the central post section 30 may include a plurality of linearly oriented posts 25, 26, and a support plate 24 concentrically mounted about a first one 25 of the rectilinear posts such that the support plate 24 receives and support the multi-section body 50. A tightening sleeve 27 may be mounted about a second one 26 of the posts and is thereby seated directly on the base section 20 such that the base section 20 is prohibited from being linearly displaced along the second post 26. Such an arrangement provides the unexpected and unpredictable benefit allowing the apparatus to be adjustably positioned in height according to the height of users without compromising the rigidity and durability of the central post section.

The invention may include a method of utilizing a free-standing athletic training apparatus 10 for improving aerobic endurance and stamina. Such a method preferably includes the chronological steps of: providing a base section 20; and providing and statically mating a central post section 30 to the base section 20 such that the central post section 30 extends upwardly therefrom. Such a central post section 30 preferably has an upper most tip 31 axially aligned with a central longitudinal axis 90 of the base section 20.

The method may additionally include the chronological steps of: providing and rotatably attaching a swiveling arm section 40 to the central post section 30; and providing and positioning a multi-section body 50 beneath the swiveling arm section 40 by locating the multi-section body 50 about the central post section 30. The method may further include the steps of: maintaining an adjustable rotational engagement between the swiveling arm section 40 and the upper most tip 31 of the central post section 30 in such a manner that the adjustable rotational engagement maintains high and low frictional contact with the upper most tip 31 when the swiveling arm section 40 is linearly lowered and raised along the central longitudinal axis 90, respectively.

The combination of such claimed elements provides an unpredictable and unexpected benefit of improving aerobic endurance and stamina and further improving precision of kicks and punches, while also solving the problem of having to utilize different sized training apparatuses for different size and height of users.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A freestanding athletic training apparatus for improving aerobic endurance and stamina, said freestanding athletic training apparatus comprising:

a base section;

a central post section mated to said base section and extending upwardly therefrom, said central post section having an upper most tip aligned with a central longitudinal axis of said base section;

a swiveling arm section rotatably attached to said central post section;

a multi-section body positioned about said central post section;

wherein said swiveling arm section maintains an adjustable rotational engagement with said upper most tip of said central post section;

wherein said adjustable rotational engagement maintains high and low frictional contact with said upper most tip when said swiveling arm is linearly lowered and raised along the central longitudinal axis respectively;

wherein said swiveling arm section comprises: a rotating arm including a bore extending downwardly from a top surface of said rotating arm;

an insert inserted into said bore;

a helical spring member seated external of said bore;

a first spring retainer;

a second spring retainer;

a retaining cap adjustably positioned external of said bore to thereby bias said helical spring member between compressed and equilibrium positions respectively;

wherein said cap includes a threadable member adjustably mated with said upper most tip of said central post section;

wherein said first spring retainer is positioned below said cap to thereby retain said spring member vertically aligned with the central longitudinal axis between the compressed and equilibrium positions respectively;

wherein said second spring retainer is positioned above said bore to thereby retain said spring member in the vertically aligned position between the compressed and equilibrium positions respectively;

wherein said frictional contact increases and decreases as said first and second spring retainers move towards and away from each other respectively;

wherein said swiveling arm section includes a channel groove formed on its bottom face, said swiveling arm section further comprising a hollow punch support linearly positioned into said channel groove of said rotating arm;

a planar punch plate having a plurality of notches formed along a leading end thereof, said notches receiving a plurality of outer edges located at a trailing end of said punch support;

a foam pad covering said punch plate; and a rotating arm cover fitted into said channel groove of said rotating arm and thereby holding said punch support at a fixed position.

2. The freestanding athletic training apparatus of claim 1, wherein said multi-section body is formed from foam and comprises: vertically stacked bottom, middle, and top sections respectively.

3. The freestanding athletic training apparatus of claim 1, wherein said base section comprises:

a centrally oriented axial bore formed therein; and a base plate fitted over a bottom end of said axial bore of said base section; and a locking bolt penetrated through said base plate and connected to said central post section to thereby maintain said central post section at a fixed and static position while said swivel arm section rotates against said upper most tip of said central post section.

4. A freestanding athletic training apparatus for improving aerobic endurance and stamina, said freestanding athletic training apparatus comprising:

a base section;

a central post section statically mated to said base section and extending upwardly therefrom, said central post section having an upper most tip axially aligned with a central longitudinal axis of said base section;

a swiveling arm section rotatably attached to said central post section;

a multi-section body positioned about said central post section, said multi-section body being located beneath said swiveling arm section;

wherein said swiveling arm section maintains an adjustable rotational engagement with said upper most tip of said central post section;

wherein said adjustable rotational engagement maintains high and low frictional contact with said upper most tip when said swiveling arm is linearly lowered and raised along the central longitudinal axis respectively;

wherein said swiveling arm section comprises: a rotating arm including a bore extending downwardly from a top surface of said rotating arm;

an insert inserted into said bore;

a helical spring member seated external of said bore;

a first spring retainer;

a second spring retainer;

a retaining cap adjustably positioned external of said bore to thereby bias said helical spring member between compressed and equilibrium positions respectively;

wherein said cap includes a threadable member adjustably mated with said upper most tip of said central post section;

wherein said first spring retainer is positioned below said cap and thereby retains said spring member vertically aligned with the central longitudinal axis between compressed and equilibrium positions respectively;

wherein said second spring retainer is positioned above said bore and thereby retains said spring member in the vertically aligned position between the compressed and equilibrium positions respectively;

wherein said frictional contact increases and decreases as said first and second spring retainers move towards and away from each other respectively;

wherein said swiveling arm section includes a channel groove formed on its bottom face, said swiveling arm section further comprising a hollow punch support linearly positioned into said channel groove of said rotating arm;

a planar punch plate having a plurality of notches formed along a leading end thereof, said notches receiving a plurality of outer edges located at a trailing end of said punch support;

a foam pad covering said punch plate; and a rotating arm cover fitted into said channel groove of said rotating arm and thereby holding said punch support at a fixed position.

5. The freestanding athletic training apparatus of claim 4, wherein said multi-section body is formed from foam and comprises: vertically stacked bottom, middle, and top sections respectively.

6. The freestanding athletic training apparatus of claim 4, wherein said base section comprises:

a centrally oriented axial bore formed therein; and a base plate fitted over a bottom end of said axial bore of said base section; and a locking bolt penetrated through said base plate and connected to said central post section to thereby maintain said central post section at a fixed and static position while said swivel arm section rotates against said upper most tip of said central post section.

* * * * *